US011355835B2

(12) United States Patent
Park et al.

(10) Patent No.: US 11,355,835 B2
(45) Date of Patent: Jun. 7, 2022

(54) ANTENNA MODULE INCLUDING DIELECTRIC AND BASE STATION INCLUDING SAME

(71) Applicant: SAMSUNG ELECTRONICS CO., LTD., Suwon-si (KR)

(72) Inventors: Jungmin Park, Suwon-si (KR); Jungyub Lee, Suwon-si (KR); Seungtae Ko, Suwon-si (KR); Yoongeon Kim, Suwon-si (KR); Youngju Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/961,756

(22) PCT Filed: Jan. 14, 2019

(86) PCT No.: PCT/KR2019/000539

§ 371 (c)(1),
(2) Date: Jul. 13, 2020

(87) PCT Pub. No.: WO2019/139437

PCT Pub. Date: Jul. 18, 2019

(65) Prior Publication Data

US 2021/0066791 A1 Mar. 4, 2021

(30) Foreign Application Priority Data

Jan. 12, 2018 (KR) ..... 10-2018-0004601

(51) Int. Cl.

| | |
|---|---|
| ***H01Q 1/38*** | (2006.01) |
| ***H01Q 1/24*** | (2006.01) |
| ***H01Q 1/46*** | (2006.01) |
| ***H01Q 21/06*** | (2006.01) |
| ***H01Q 21/24*** | (2006.01) |

(52) U.S. Cl.

CPC ..... *H01Q 1/38* (2013.01); *H01Q 1/246* (2013.01); *H01Q 1/46* (2013.01); *H01Q 21/065* (2013.01); *H01Q 21/24* (2013.01)

(58) Field of Classification Search

CPC ..... H01Q 1/38; H01Q 1/246; H01Q 1/46; H01Q 21/065; H01Q 21/24; H01Q 9/0414; H01Q 9/0457

See application file for complete search history.

(56) References Cited

U.S. PATENT DOCUMENTS

| | | | | |
|---|---|---|---|---|
| 2016/0190704 | A1* | 6/2016 | Celik | H01Q 9/0435 343/700 MS |
| 2017/0194703 | A1 | 7/2017 | Watson | |
| 2017/0271772 | A1 | 9/2017 | Miraftab et al. | |
| 2018/0316098 | A1* | 11/2018 | Amadjikpe | H01Q 9/0457 |

FOREIGN PATENT DOCUMENTS

| | | |
|---|---|---|
| JP | 11-074721 | 3/1999 |
| JP | H11-74721 | 3/1999 |

(Continued)

OTHER PUBLICATIONS

International Search Report for PCT/KR2019/000539 dated Apr. 22, 2019, 4 pages.

(Continued)

*Primary Examiner* — David E Lotter

(74) *Attorney, Agent, or Firm* — Nixon & Vanderhye, P.C.

(57) ABSTRACT

An example embodiment provides an antenna module including at least one antenna array including a first dielectric having a plate shape; a second dielectric disposed on a top of the first dielectric, wherein a top of the second dielectric is separated from the top of the first dielectric by a first distance; a first radiator disposed on the top surface of the second dielectric; and a feeder disposed on the first dielectric and on the second dielectric to supply an RF signal to the first radiator; and a feeder disposed on the first dielectric and the second dielectric and configured to supply a radio frequency (RF) signal to the first radiator.

18 Claims, 13 Drawing Sheets

(56) References Cited

FOREIGN PATENT DOCUMENTS

| | | |
|---|---|---|
| JP | 3384903 | 3/2003 |
| KR | 10-2010-0030025 | 3/2010 |
| KR | 10-2010-0053115 | 5/2010 |

OTHER PUBLICATIONS

Written Opinion of the ISA for PCT/KR2019/000539 dated Apr. 22, 2019, 5 pages.
Extended European Search Report dated Nov. 30, 2020 in counterpart European Patent Application No. EP19738982.8.
Mak C. L. et al, "Microstrip Line-Fed L-Strip Patch Antenna, " IEE Proceedings: Microwaves, Antennas and and Wireless Propagation, vol. 146, No. 4, Aug. 31, 1999, pp. 282-284 (3 pages).
Lau K. L. et al, "A Wideband Dual-Polarized L-Probe Stacked Patch Antenna Array," IEEE Antennas and Wireless Propagation Letters, vol. 6, Nov. 27, 2007, pp. 529-532 (4 pages).
Zhang Jin et al, "Wideband Dual-Polarization Patch Antenna Array with Parallel Strip Line Balun Feeding," IEEE Antennas and Wireless Propagation Letters, vol. 15, Jan. 5, 2016, pp. 1499-1501 (3 pages).
Notice of Preliminary Rejection dated Jan. 25, 2022 in counterpart Korean Patent Application No. 10-2018-0004601 and English-language translation.
Communication pursuant to Article 94(3) EPC dated Apr. 12, 2022 in counterpart European Patent Application No. EP19738982.8.

* cited by examiner

ANTENNA MODULE INCLUDING DIELECTRIC AND BASE STATION INCLUDING SAME

This application is the U.S. national phase of International Application No. PCT/KR2019/000539 filed Jan. 14, 2019 which designated the U.S. and claims priority to KR Patent Application No. 10-2018-0004601 filed Jan. 12, 2018, the entire contents of each of which are hereby incorporated by reference.

TECHNICAL FIELD

The disclosure relates to an antenna module that is used in the next generation communication technology, and a base station including the antenna module.

BACKGROUND ART

To meet the demand for wireless data traffic having increased since deployment of 4G communication systems, efforts have been made to develop an improved 5G or pre-5G communication system. Therefore, the 5G or pre-5G communication system is also called a "Beyond 4G Network" or a "Post LTE System". The 5G communication system is considered to be implemented in higher frequency (mmWave) bands, e.g., 60 GHz bands, so as to accomplish higher data rates. To decrease propagation loss of the radio waves and increase the transmission distance, the beamforming, massive multiple-input multiple-output (MIMO), full dimensional MIMO (FD-MIMO), array antenna, an analog beam forming, large scale antenna techniques are discussed in 5G communication systems. In addition, in 5G communication systems, development for system network improvement is under way based on advanced small cells, cloud radio access networks (RANs), ultra-dense networks, device-to-device (D2D) communication, wireless backhaul, moving network, cooperative communication, coordinated multi-points (CoMP), reception-end interference cancellation and the like. In the 5G system, hybrid FSK and QAM modulation (FQAM) and sliding window superposition coding (SWSC) as an advanced coding modulation (ACM), and filter bank multi carrier (FBMC), non-orthogonal multiple access(NOMA), and sparse code multiple access (SCMA) as an advanced access technology have also been developed.

The Internet, which is a human centered connectivity network where humans generate and consume information, is now evolving to the Internet of things (IoT) where distributed entities, such as things, exchange and process information without human intervention. The Internet of everything (IoE), which is a combination of the IoT technology and the big data processing technology through connection with a cloud server, has emerged. As technology elements, such as "sensing technology", "wired/wireless communication and network infrastructure", "service interface technology", and "security technology" have been demanded for IoT implementation, a sensor network, a machine-to-machine (M2M) communication, machine type communication (MTC), and so forth have been recently researched. Such an IoT environment may provide intelligent Internet technology services that create a new value to human life by collecting and analyzing data generated among connected things. IoT may be applied to a variety of fields including smart home, smart building, smart city, smart car or connected cars, smart grid, health care, smart appliances and advanced medical services through convergence and combination between existing information technology (IT) and various industrial applications.

In line with this, various attempts have been made to apply 5G communication systems to IoT networks. For example, technologies such as a sensor network, machine type communication (MTC), and machine-to-machine (M2M) communication may be implemented by beamforming, MIMO, and array antennas. Application of a cloud radio access network (RAN) as the above-described big data processing technology may also be considered an example of convergence of the 5G technology with the IoT technology.

SUMMARY

A next generation communication system may include a superhigh frequency band (mmWave). Accordingly, in order use a next generation communication system, there is a need for an antenna module structure that can smoothly perform communication even in the superhigh frequency band. Therefore, the disclosure provides an antenna module that has high efficiency and gain in a next generation communication system and can be manufactured through a simple process.

The disclosure provides an antenna module that includes at least one antenna array including: a first dielectric having a plate shape; a second dielectric disposed on a top of the first dielectric, wherein a top of the second dielectric is separated from the top of the first dielectric by a first distance; a first radiator disposed on the top of the second dielectric; and a feeder disposed on the first dielectric and the second dielectric and configured to supply a radio frequency (RF) signal to the first radiator.

The feeder may include: a first feeder configured to extend to the top of the second dielectric and supply an RF signal related to a horizontal polarized wave to the first radiator; and a second feeder configured to extend to the top of the second dielectric and supply an RF signal related to a vertical polarized wave to the first radiator, wherein an extension line of the first feeder is perpendicular to an extension line of the second feeder on the top of the second dielectric.

The first distance may be determined based on a wavelength of an electronic wave that is radiated from the first radiator.

The feeder is separated from the first radiator by a second distance.

The second distance may be determined based on a wavelength of an electronic wave that is radiated from the first radiator.

A space may be defined along the outer side of the second dielectric in the second dielectric.

The antenna module may further include a second radiator disposed on a bottom of the second dielectric that faces the top of the first dielectric and the space, in which the first radiator and the second radiator may be electrically connected to each other through a via.

The antenna module may further include: a third dielectric spaced a second distance apart from the second dielectric on the top of the first dielectric, wherein a top of the third dielectric is separated from the top of the first dielectric by the first distance; a second radiator disposed on the top of the third dielectric; and a distributor configured to distribute the RF signal, wherein the feeder supply the RF signal distributed by the distributor to each of the first radiator and the second radiator.

At least one second dielectric may have a column shape of which a height is the first distance and may be disposed on the top of the first dielectric, and the first radiator may be disposed on the top of the at least one second dielectric.

The antenna module may further include at least one third dielectric disposed on the top of the first dielectric, wherein a top of the at least one third dielectric is separated from the top of first dielectric by a third distance, and the feeder may extend to the top of the third dielectric.

The third distance may be shorter than the first distance and a difference between the first distance and the third distance may be determined based on a frequency of an electronic wave that is radiated from the first radiator or an overlapping area of the first radiator and the feeder.

The antenna module may further include a wireless communication chip or a circuit board disposed on a bottom of the first dielectric and configured to supply the RF signal to the feeder through a via formed in the first dielectric.

The disclosure provides a base station that includes at least one antenna array including: a first dielectric having a plate shape; a second dielectric disposed on a top of the first dielectric, wherein a top of the second dielectric is separated from the top of the first dielectric by a first distance; a first radiator disposed on the top of the second dielectric; and a feeder disposed on the first dielectric and the second dielectric and configured to supply a radio frequency (RF) signal to the first radiator.

The feeder may include: a first feeder configured to extend to the top of the second dielectric and supply an RF signal related to a horizontal polarized wave to the first radiator; and a second feeder configured to extend to the top of the second dielectric and supply an RF signal related to a vertical polarized wave to the first radiator, wherein an extension line of the first feeder is perpendicular to an extension line of the second feeder on the top of the second dielectric.

The second dielectric may have a space therein defined along an outer side of the second dielectric.

The base station may further include a second radiator disposed on a bottom of the second dielectric that faces the top of the first dielectric and the space, in which the first radiator and the second radiator may be electrically connected to each other through a via.

The base station may further include: a third dielectric spaced a second distance apart from the second dielectric on the top of the first dielectric, wherein a top of the third dielectric is separated from the top of the first dielectric by the first distance; a second radiator disposed on the top of the third dielectric; and a distributor configured to distribute the RF signal, in which the feeder supply the RF signal distributed by the distributor to each of the first radiator and the second radiator.

At least one second dielectric may have a column shape of which a height is the first distance and may be disposed on the top of the first dielectric, and the first radiator may be disposed on the top of the at least one second dielectric.

The base station may further include at least one third dielectric disposed on the top of the first dielectric, wherein a top of the at least one third dielectric is separated from the top of first dielectric by a third distance.

The base station may further include a wireless communication chip or a circuit board disposed on a bottom of the first dielectric and configured to supply the RF signal to the feeder through a via formed in the first dielectric.

According to an embodiment, it is possible to configure an antenna module by disposing only a radiator or a feeder in a 3D dielectric structure, so the manufacturing process of the antenna module is simplified. Accordingly, it is possible to obtain the effect that reduce the manufacturing cost, improve the manufacturing process efficiency, and decrease the defective proportion of the antenna module.

Further, the performance of an antenna module is improved by using a gap-coupled structure that secures a gap between a feeder and a radiator, thereby being able to decrease the size of the antenna module.

DETAILED DESCRIPTION OF EXAMPLE EMBODIMENTS

Figure 1:
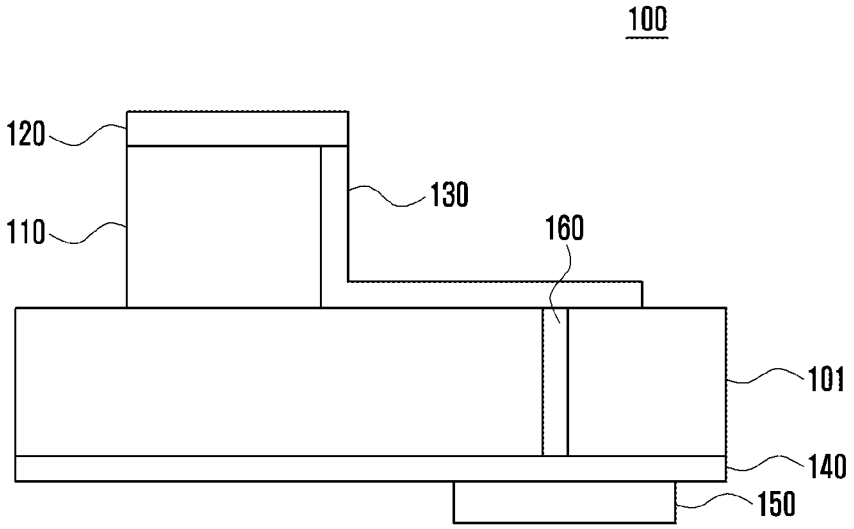
FIG. 1 is a side view of an antenna array according to an embodiment of the disclosure.

In describing embodiments of the disclosure, descriptions related to technical contents well-known in the art and not associated directly with the disclosure will be omitted. Such an omission of unnecessary descriptions is intended to prevent obscuring of the main idea of the disclosure and more clearly transfer the main idea.

For the same reason, in the accompanying drawings, some elements may be exaggerated, omitted, or schematically illustrated. Further, the size of each element does not completely reflect the actual size. In the drawings, identical or corresponding elements are provided with identical reference numerals.

The advantages and features of the disclosure and ways to achieve them will be apparent by making reference to embodiments as described below in detail in conjunction with the accompanying drawings. However, the disclosure is not limited to the embodiments set forth below, but may be implemented in various different forms. The following embodiments are provided only to completely disclose the disclosure and inform those skilled in the art of the scope of the disclosure, and the disclosure is defined only by the scope of the appended claims. Throughout the specification, the same or like reference numerals designate the same or like elements.

Here, it will be understood that each block of the flowchart illustrations, and combinations of blocks in the flowchart illustrations, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions specified in the flowchart block or blocks. These computer program instructions may also be stored in a computer usable or computer-readable memory that can direct a computer or other programmable data processing apparatus to function in a particular manner, such that the instructions stored in the computer usable or computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart block or blocks.

Further, each block of the flowchart illustrations may represent a module, segment, or portion of code, which includes one or more executable instructions for implementing the specified logical function(s). It should also be noted that in some alternative implementations, the functions noted in the blocks may occur out of the order. For example, two blocks shown in succession may in fact be executed substantially concurrently or the blocks may sometimes be executed in the reverse order, depending upon the functionality involved.

As used herein, the "unit" refers to a software element or a hardware element, such as a Field Programmable Gate Array (FPGA) or an Application Specific Integrated Circuit (ASIC), which performs a predetermined function. However, the "unit" does not always have a meaning limited to software or hardware. The "unit" may be constructed either to be stored in an addressable storage medium or to execute one or more processors. Therefore, the "unit" includes, for example, software elements, object-oriented software elements, class elements or task elements, processes, functions, properties, procedures, sub-routines, segments of a program code, drivers, firmware, micro-codes, circuits, data, database, data structures, tables, arrays, and parameters. The elements and functions provided by the "unit" may be either combined into a smaller number of elements, or a "unit", or divided into a larger number of elements, or a "unit". Moreover, the elements and "units" or may be implemented to reproduce one or more CPUs within a device or a security multimedia card. Further, the "unit" in the embodiments may include one or more processors.

FIG. 1 is a side view of an antenna array according to an embodiment of the disclosure.

The antenna module structure disclosed in the specification including FIG. 1 can be applied to a next generation communication system too. In particular, the antenna module structure disclosed in the specification can be applied to a communication system of which the operation frequency is 6 GH or less.

According to an embodiment, an antenna module may include at least one antenna array 200 and 300. For example, one antenna module may have a 4×4 antenna array structure. That is, one antenna module may have 16 (4×4=16) antenna arrays 200 and 300. This will be described below in more detail with reference to FIG. 7.

The antenna array 100 shown in FIG. 1 may include a first dielectric 101 having a plate shape, a second dielectric 110 disposed on the top of the first dielectric 101 with the top thereof spaced a predetermined first distance apart from the top of the first dielectric 101, a first radiator 120 disposed on the top of the second dielectric 110, and a feeder 130 disposed on the first dielectric 101 and the second dielectric 110 and supplying an RF signal to the first radiator 120.

Although it is assumed that the first dielectric 101 and the second dielectric 110 are separate components in FIG. 1, the first dielectric 101 and the second dielectric 110 may be integrated in a single component. According to an embodiment, the first dielectric 101 and the second dielectric 110 may be formed as one dielectric and a protrusion may be formed on the top of the first dielectric, on which the second dielectric is disposed, to correspond to the height of the second dielectric 100.

According to an embodiment, a metal plate 140 may be disposed on the bottom of the first dielectric 101 and the metal plate 140 may be a ground layer. According to an embodiment, a wireless communication chip 150 or a Printed Circuit Board (PCB) may be disposed on the bottom of the metal plate 140 or the bottom of the first dielectric 101. The wireless communication chip 150 or the PCB can transmit an RF signal for operating the first radiator 120 as an antenna.

According to an embodiment, the wireless communication chip 150 may be electrically connected with the feeder 130 through the first dielectric 101 by a via 160. The wireless communication chip 150 can supply an RF signal to the first radiator 120 through the feeder 130.

According to an embodiment, the first distance that is the distance between the first radiator 120 and the first dielectric 101 may be determined based on the wavelength of an electronic wave that is radiated from the first radiator 120. For example, the first length may be proportioned to the wavelength of the electronic wave that is radiated from the first radiator 120.

Although only the method of configuring an antenna module using dielectric is disclosed in the specification, the dielectrics may be replaced by a nonmetallic material excluding a dielectric. According to an embodiment, the dielectric structure including the first dielectric 101 and the second dielectric 110 may be manufactured by injection molding. According to an embodiment, the first radiator 120 and the feeder 130 may be formed by printing on the injected dielectric or may be separately pressed and then coupled to the injected dielectric.

Accordingly, the antenna module structure disclosed in the specification is obtained through a more simple process than an antenna module structure using a PCB. Further, the number of components of the antenna module is smaller than that of an antenna module structure using a PCB (e.g., a PCB may be removed). Therefore, it is possible to expect the effect of reducing the manufacturing cost when using the antenna module structure disclosed in the specification.

Figure 2A:
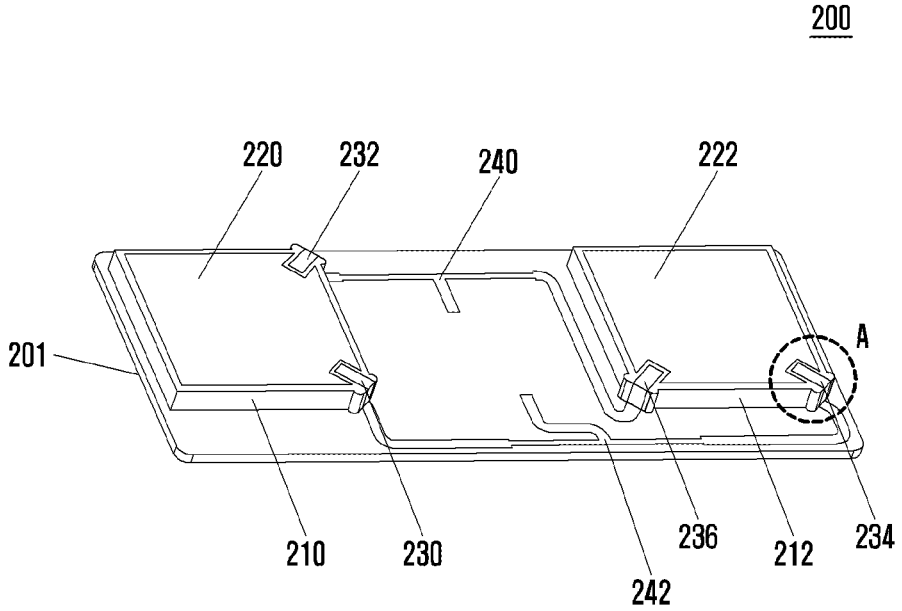
FIG. 2A is a view showing a first embodiment of an antenna array structure including two radiators.

FIG. 2A is a view showing a first embodiment of an antenna array structure including two emitters.

The antenna array 200 shown in FIG. 2A may include: a first dielectric 201 having a plate shape; a second dielectric 210 disposed on the top of the first dielectric 201 with the top thereof spaced a predetermined first distance from the top of the first dielectric 201; a third dielectric 212 disposed on the top of the first dielectric 201 and spaced a predetermined second distance from the second dielectric 210 with the top thereof spaced the first distance from the top of the first dielectric 201; a first radiator 220 disposed on the top of the second dielectric 210; a second radiator 222 disposed on the top of the third dielectric 212; feeders 230, 232, 234, and 236 supplying an RF signal to the first radiator 220 and the second radiator 222; and distributors 240 and 242 distributing the RF signal to the first radiator 220 and the second radiator 222.

According to an embodiment, the feeder 230 may be classified into feeders 230 and 232 facing the first radiator 220 and feeders 234 and 236 facing the second radiator 222 through the distributors 240 and 242 disposed on the top of the first dielectric 201.

According to an embodiment, the feeders 230 and 232 facing the first dielectric 220 may include a first feeder 230 that supplies an RF signal related to a horizontal polarized wave to the first radiator 220 and a second feeder 232 that supplies an RF signal related to a vertical polarized wave to the first radiator 220.

According to an embodiment, the first feeder 230 and the second feeder 232 may extend from the top of the first dielectric 201 to the top of the second dielectric 210 via a side of the second dielectric 210. The extension line of the first feeder 230 and the extension line of the second feeder 232 may be perpendicular to each other on the top of the second dielectric 210.

Since the extension line of the first feeder 230 and the extension line of the second feeder 232 are perpendicular to each other, the gain values of the horizontal polarized wave and the vertical polarized wave radiated from the first radiator 220 can be improved.

Although the first supplier 230 can supply an RF signal related to a horizontal polarized wave and the second feeder 232 can supply an RF signal related to a vertical polarized wave in the disclosure, they may be switched. That is, the first supplier 230 may supply an RF signal related to a vertical polarized wave and the second feeder 232 may supply an RF signal related to a horizontal polarized wave.

According to an embodiment, the third dielectric 212 spaced the second distance apart from the second dielectric 210, and the second radiator 222 and the feeders 234 and 236 disposed on the third dielectric 212 may also be similar to or the same as the antenna array structure using the second dielectric 210 described above.

However, the positions of the feeders disposed on the second dielectric 210 and the third dielectric 212 may be different. In the antenna module structure shown in FIG. 2, for example, it the first feeder 230 may be disposed at the right corner of a square bottom of the second dielectric 210 of which the top has a square shape and the second feeder 232 is disposed at the right corner of the square top, similarly, the third feeder 234 may be disposed at the right corner of a square bottom of the third dielectric 212 of which the top has a square shape, as in the second dielectric 210, but the fourth feeder 236 may be disposed at the left corner of the square bottom.

That is, the first feeder 230 and the third feeder 234 may be disposed at the same positions, respectively, but the second feeder 232 and the fourth feeder 236 may be disposed at different positions, on the second dielectric 210 and the third dielectric 212. However, even in this case, the extension lines of the first feeder 230 and the second feeder 232 may be perpendicular to each other on the top of the second dielectric 210 and the extension lines of the third feeder 234 and the fourth feeder 236 may be perpendicular to each other on the third dielectric 212.

Since the second feeder 232 and the fourth feeder 236 may be disposed at different positions on dielectrics having the same shape, according to an embodiment, the distance from the distributor 240 to the second feeder 232 and the distance from the distributor 240 to the fourth feeder 236 may be different from each other. That is, it is possible to compensate for the phase difference between RF signals that are supplied through the second feeder 232 and the fourth feeder 236 using the distance difference.

Although only the came in which the tops of the second dielectric and the third dielectric have square shapes is shown in FIG. 2A, the second dielectric and the third dielectric are not limited to the shape and may have various shapes.

Figure 2B:
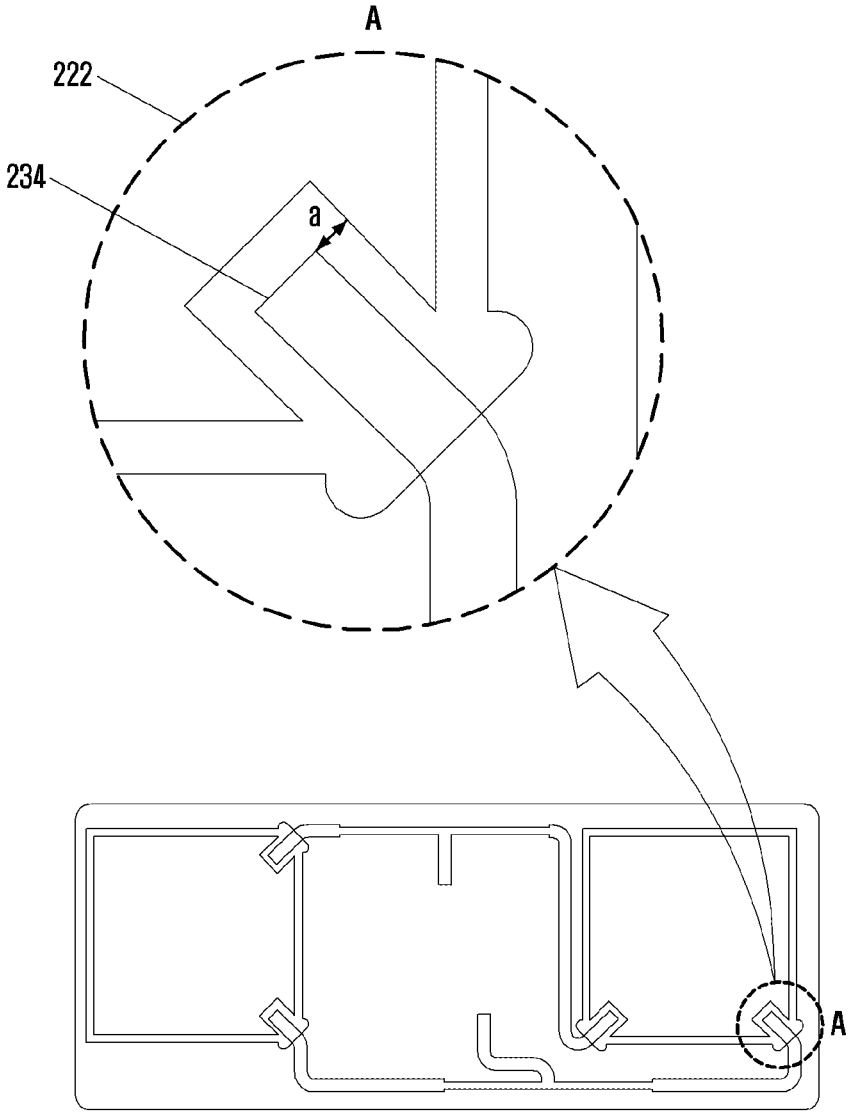
FIG. 2B is a view enlarging the portion A of the antenna array structure shown in FIG. 2A.

FIG. 2B is a view enlarging the portion A of the antenna array structure shown in FIG. 2A.

According to an embodiment, the first feeder 230 and the second feeder 232 may be disposed at a predetermined second distance (distance 'a') from the first radiator 220, and the third feeder 234 and the fourth feeder 236 may be disposed at the second distance (a) from the second radiator 222.

That is, the feeders and the radiators each may have a gap-coupled structure. All the feeders and radiators are made of a metal material, the feeders and the radiators are spaced the second distance apart from each other, and dielectrics are disposed in the spaces between the feeders and the radiators. Accordingly, it is possible to achieve the effect that a capacitor or an inverter is disposed between the feeders and the radiators by the structure described above, and accordingly, it is possible to improve the bandwidth of the electronic waves that are radiated from the radiators. According to an embodiment, the second distance (a) may be determined based on the frequency of the electronic waves that are radiated from the radiators.

Figure 3A:
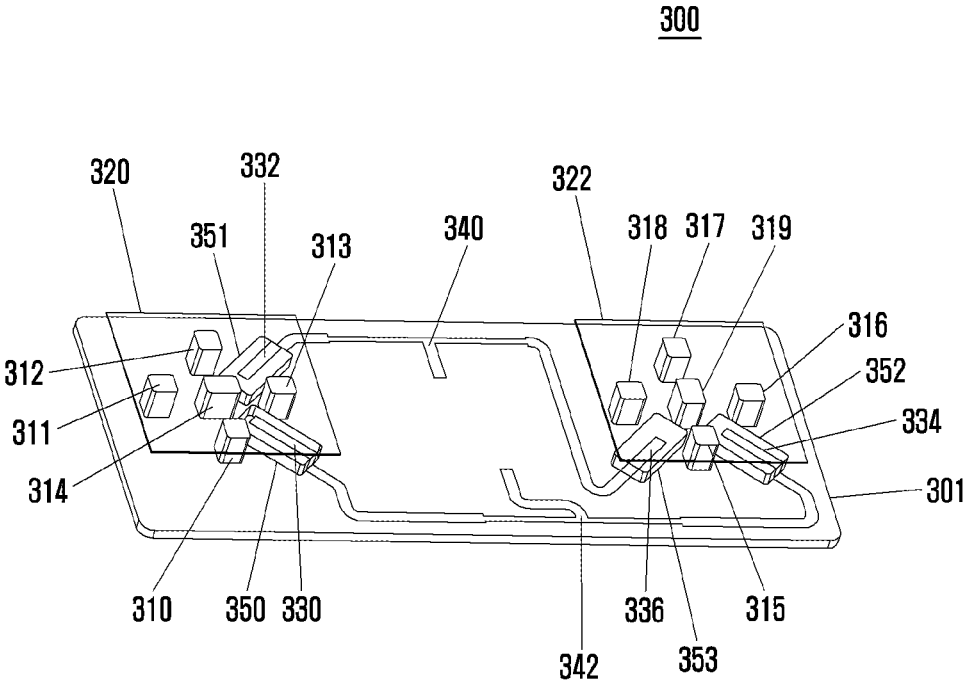
FIG. 3A is a view showing a second embodiment of an antenna array structure including two radiators.

FIG. 3A is a view showing a second embodiment of an antenna array structure including two radiators.

According to an embodiment, a plurality of second dielectrics 310, 311, 312, 313, 314, 315, 316, 317, 318, and 319 having a column shape having a height of a first distance may be disposed on the top of the first dielectric 301.

According to an embodiment, a first radiator 320 may be disposed on five second dielectrics 310, 311, 312, 313, and 314 and a second radiator 322 may be disposed on other five second dielectrics 315, 316, 317, 318, and 319.

According to an embodiment, third dielectrics 350 and 351 may be disposed on the top of the first dielectric 301 and the tops of the third dielectrics 350 and 351 may be spaced a third distance apart from the top of the first dielectric 301.

According to an embodiment, feeders 330 and 332 may extend to the tops of the third dielectrics 350 and 351. That is, the first feeder 330 may extend to the top of the third dielectric 350 and the second feeder 332 may extend to the top of the third dielectric 351. In this case, as described above, the extension line of the first feeder 330 and the extension line of the second feeder 332 may be perpendicular to each other.

According to an embodiment, the third distance may be shorter than the first distance. That is, the heights of the third dielectrics 350, 351, 352, and 353 may be smaller than the heights of the second dielectrics 310, 311, 312, 313, 314, 315, 316, 317, 318, and 319. This will be described below in detail with reference to FIG. 3B.

An antenna array structure (an antenna array including the second dielectrics 315, 316, 317, 318, and 319, the third dielectrics 352 and 353, and the feeders 334 and 336) corresponding to the second radiator 322 may be the same as or similar to an antenna array corresponding to the first radiator 320. In the antenna array 300 shown in FIG. 3A, the first dielectric 301 and the distributors 340 and 342 may be the same as or similar to the antenna array structure described with reference to FIG. 2A.

Figure 3B:
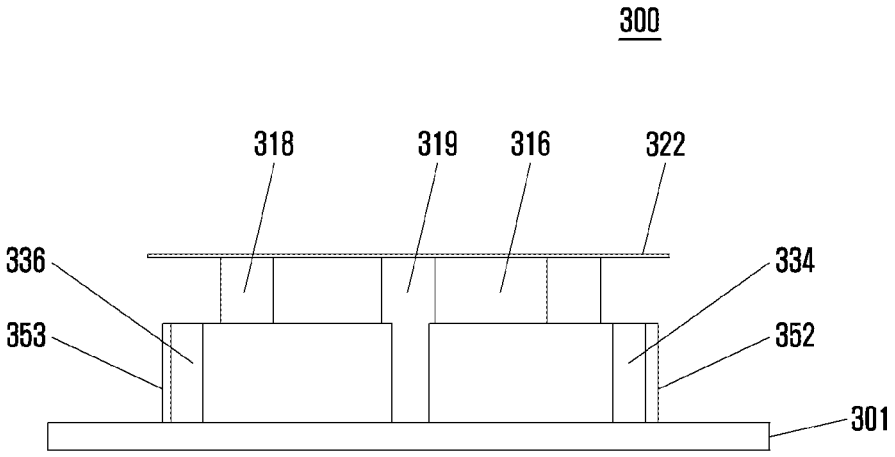
FIG. 3B is a side view of the antenna array shown in FIG. 3A.

FIG. 3B is a side view of the antenna array shown in FIG. 3A.

According to an embodiment, the third distance that is the height of the third dielectrics 352 and 353 may be shorter than the first distance that is the height of the second dielectric 319. The radiator 322 may be disposed on the top of the second dielectric 319, and the feeders 334 and 336 may be disposed on the tops of the third dielectrics 352 and 353, respectively.

According to an embodiment, the feeders, as described above, may include a first feeder 334 for forming a horizontal polarized wave and a second feeder 336 for forming a vertical polarized wave, and the third dielectric 352 on which the first feeder 334 is disposed and the third dielectric 335 on which the second feeder 336 is disposed may be perpendicular to each other (that is, the longitudinal center lines of the third dielectric 352 and the third dielectric 353 may be perpendicular to each other).

Since the third distance that is the height of the third dielectrics 352 and 353 on which the feeders 334 and 336 are disposed is shorter than the first distance that is the height of the second dielectric 319 on which the radiator 322 is disposed, there may be a distance difference between the radiator 322 and the feeders 334 and 336. For example, if the height of the second dielectric 319 is 3 mm and the heights of the third dielectric 352 and 353 is 2 mm, there may be a distance difference of 1 mm between the radiator 322 and the feeders 334 and 336.

In this case, the portion between the radiator 322 and the feeders 334 and 336 is filled with a dielectric or air, so the structure between the radiator 322 and the feeders 334 and 336 may be the gap-coupled structure described above.

Accordingly, a gap-coupled structure can be formed in the antenna array due to the difference between the first distance and the third distance, and accordingly, it is possible to improve the bandwidth of the frequency that is radiated from the radiator 322.

According to an embodiment, the difference between the first distance and the third distance may be determined based on the frequency of the electronic wave to be radiated from the radiator 322 or the overlap area of the radiator 322 and the feeders 334 and 336.

Figure 4A:
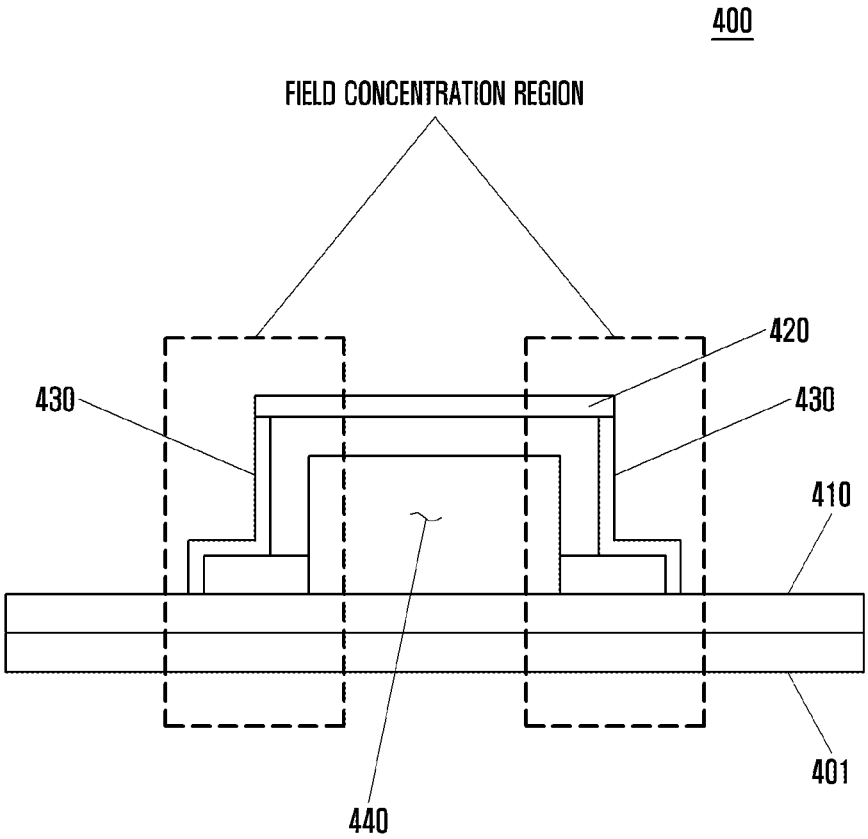
FIGS. 4A and 4B are side views of an antenna array when a space is defined in a second dielectric in accordance with an embodiment of the disclosure.
Figure 4B:
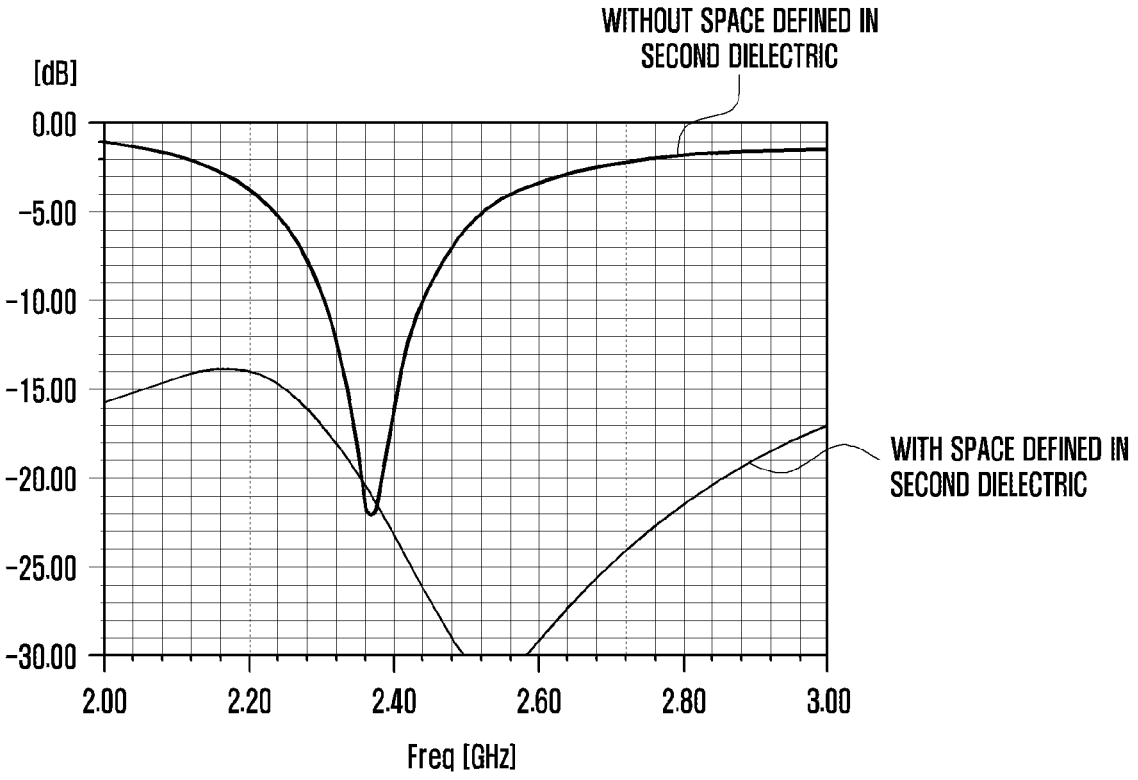

FIG. 4 is a side view of an antenna array when a space is defined in a second dielectric in accordance with an embodiment of the disclosure.

According to an embodiment, in a second dielectric 410 of an antenna array 400, a space 440 may be defined along the outer sides of the second dielectric 410. The space 440 may be a closed space surrounded by the tops of the second dielectric 410 and a first dielectric 401.

According to an embodiment, a radiator 420 may be included on the top of the second dielectric 410 and a feeder 430 may be disposed along a side of the second dielectric 410 to be able to supply an RF signal to the radiator 420.

According to an embodiment, when the space 440 is defined in the second dielectric 410 and an RF signal is supplied to the radiator 420 through the feeder 430, electric field distribution generated by the RF signal may concentrate on the side of the second dielectric 410. That is, the electric field density of the side of the second dielectric 410 may be higher than the electric field density of the space 440 in the second dielectric 410.

Accordingly, isolation of a vertical polarized wave and a horizontal polarized wave that are radiated from the radiator 420 can be improved, so the performance of the antenna array 400 can be improved.

Although only the case in which the space 440 defined in the second dielectric becomes a closed space by being surrounded by the tops of the second dielectric 410 and the first dielectric 401 is shown in FIG. 4, the right range of the disclosure should not be construed as being limited thereto. The space 440 may be an open space, which will be described below in detail with reference to FIGS. 6A to 6C.

Figure 5:
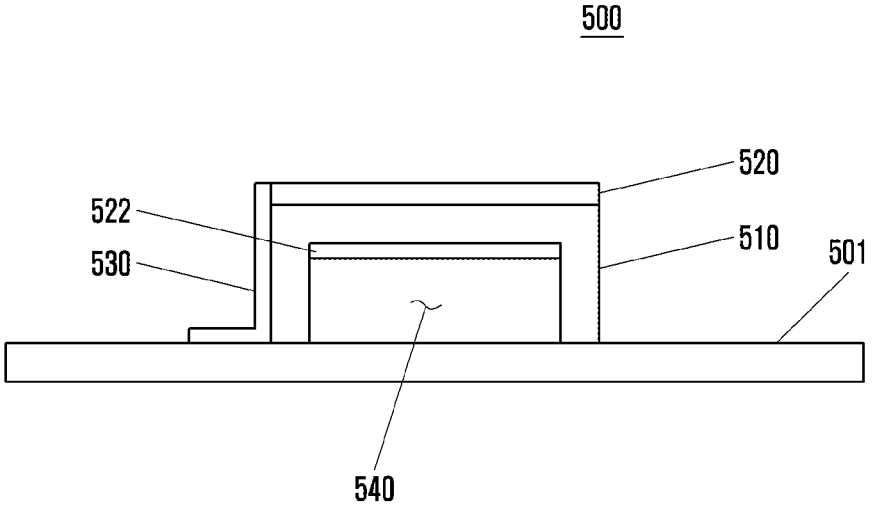
FIG. 5 is a side view of an antenna array when two radiators are disposed in one second dielectric in accordance with an embodiment of the disclosure.

FIG. 5 is a side view of an antenna array when two emitters are disposed in one second dielectric in accordance with an embodiment of the disclosure.

In an antenna array 500 shown in FIG. 5, the structures of a first dielectric 501, a second dielectric 502, and a feeder 530 may be the same as or similar to the antenna array shown in FIG. 4A. That is, in the second dielectric 510, a space 540 may be defined along the outer side of the second dielectric 510.

However, according to the antenna array 500 shown in FIG. 5, a first feeder 520 may be disposed on the top of the second dielectric, a second feeder 522 may be disposed on the bottom of the second dielectric, and the first feeder 520 and the second feeder 522 may be electrically connected to each other through a via. According to an embodiment, the antenna array 500 radiate electronic waves through two feeders 520 and 522, whereby the gain value of the antenna array 500 can be improved.

Although the feeder 530 directly supplies an RF signal to the first feeder 520 disposed on the top of the second dielectric 510 in FIG. 5, the right range of the disclosure should not be construed as being limited thereto.

For example, the feeder 530 may directly supply an RF signal to the second radiator 522 disposed on the bottom of the second dielectric 510 and the first radiator 520 may indirectly receive an RF signal through a via formed in the second dielectric 510.

Figure 6A:
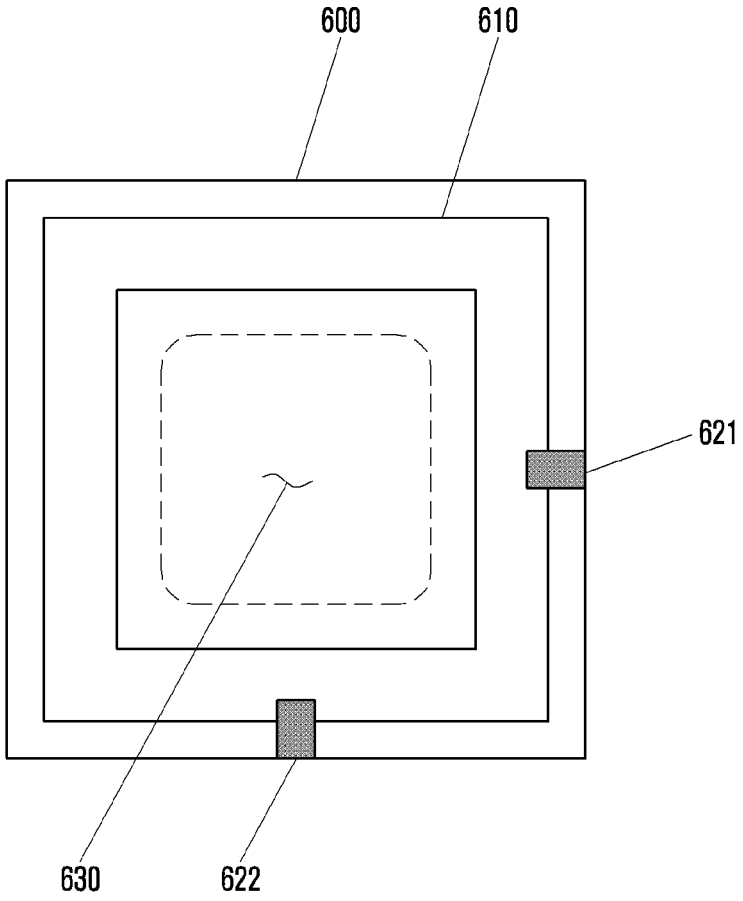
FIG. 6A is a view showing a first embodiment of an antenna array structure when a space is defined in a second dielectric.

FIG. 6A is a view showing a first embodiment of an antenna array structure when a space is defined in a second dielectric.

In more detail, FIG. 6A is a view showing the case in which a closed space 630 is defined in a second dielectric 610. According to an embodiment, a second dielectric 610 surrounding the space 630 may be disposed on the top of the first dielectric 600. Although the second dielectric 610 has a square column shape with the space 630 therein in FIG. 6A, the right range of the disclosure should not be construed as being limited thereto.

According to an embodiment, a first feeder 621 and a second feeder 622 may be disposed on a side of the second dielectric 610. In this case, as described above, the extension lines of the first feeder 621 and the second feeder 622 may be perpendicular to each other on the top of the second dielectric 610.

Figure 6B:
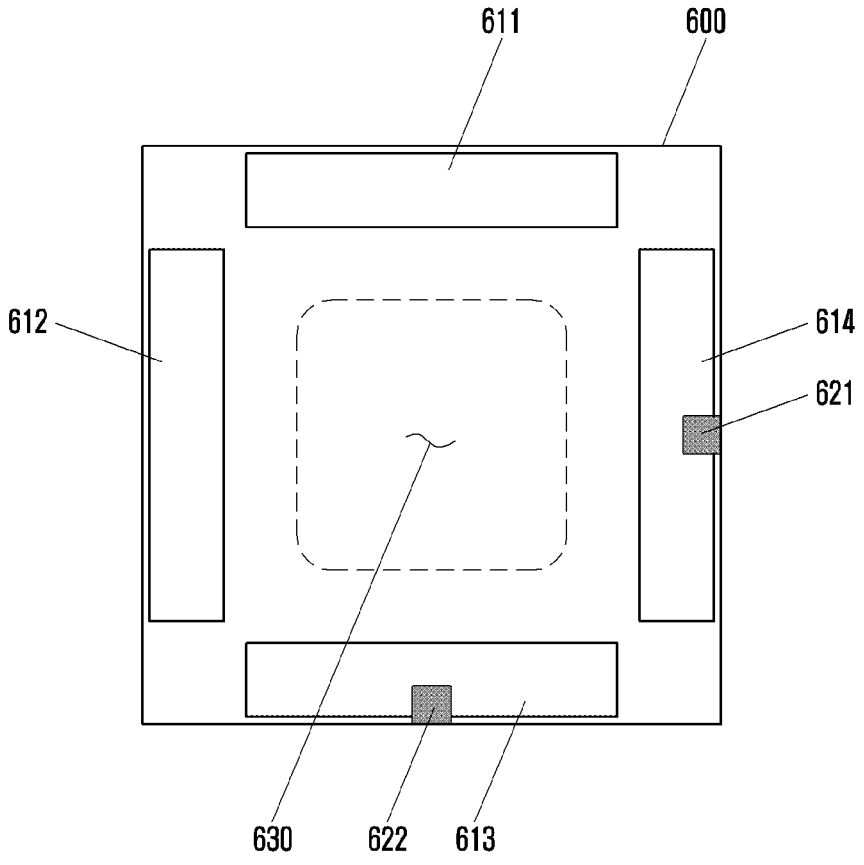
FIG. 6B is a view showing a second embodiment of an antenna array structure when a space is defined in a second dielectric.

FIG. 6B is a view showing a second embodiment of an antenna array structure when a space is defined in a second dielectric.

In more detail, FIG. 6B is a view showing the case in which an open space 630 is defined inside second dielectrics 611, 612, 613, and 614. That is, FIG. 6B shows an antenna array 600 in which four second dielectrics 611, 612, 613, and 614 each which have cuboid shape surround the space 630.

According to an embodiment, the second dielectrics 611, 612, 613, and 614 may be spaced a specific distance from each other, and accordingly, the space 630 surrounded by the second dielectrics 611, 612, 613, and 614 may be an open space.

According to an embodiment, a first feeder 621 may be disposed on the second dielectric 614 and a second feeder 622 may be disposed on the second dielectric 613. In this case, the extension line of the second dielectric 612 on which the first feeder 621 is disposed and the extension line of the second dielectric 613 on which the second feeder 622 is disposed may be perpendicular to each other.

Figure 6C:
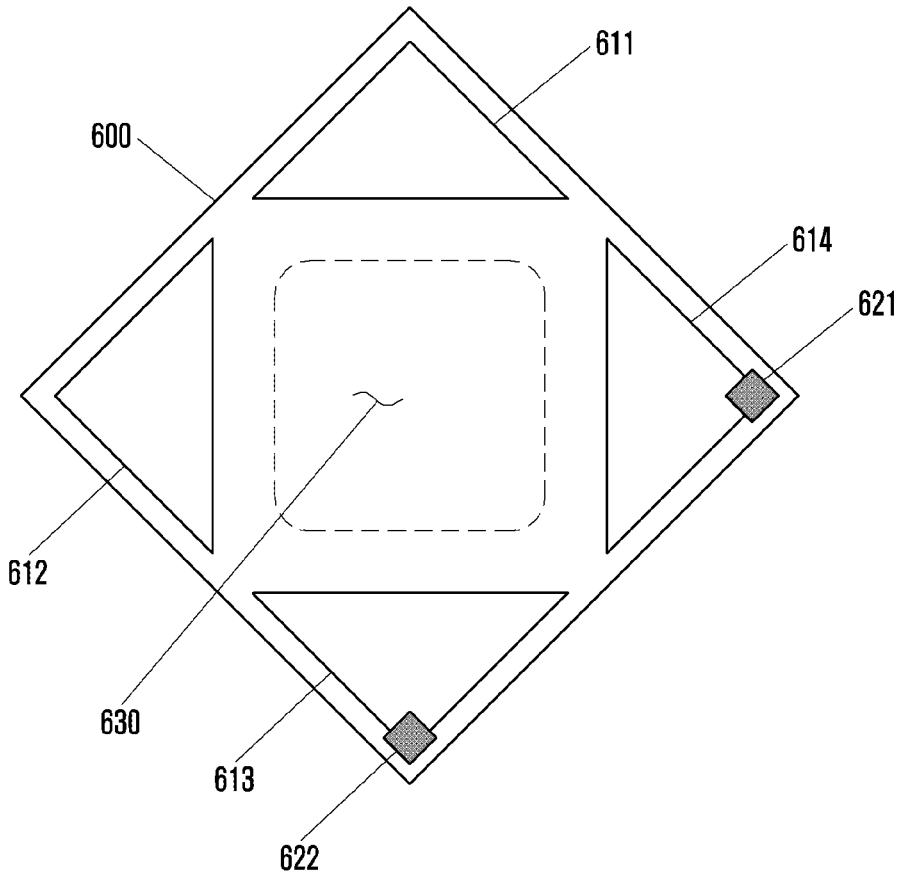
FIG. 6C is a view showing a third embodiment of an antenna array structure when a space is defined in a second dielectric.
Figure 6D:
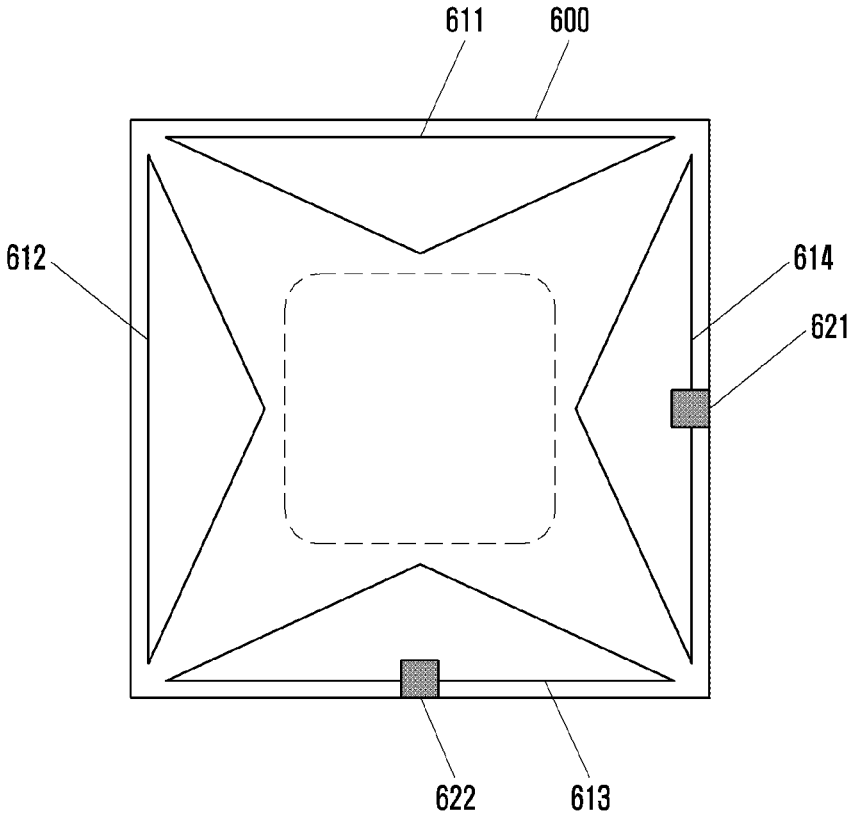
FIG. 6D is a view showing another embodiment of an antenna array structure.

FIG. 6C is a view showing a third embodiment of an antenna array structure when a space is defined in a second dielectric.

In more detail, FIG. 6C is a view showing the case in which an open space 630 is defined inside second dielectric 611, 612, 613, and 614. That is, FIG. 6C shows an antenna array 600 in which four second dielectrics 611, 612, 613, and 614 each which have a triangular column shape surround the space 630.

According to an embodiment, the second dielectrics 611, 612, 613, and 614 may be spaced a specific distance from each other, and accordingly, the space 630 surrounded by the second dielectrics 611, 612, 613, and 614 may be an open space.

According to an embodiment, a first feeder 621 may be disposed on the second dielectric 614 and a second feeder 622 may be disposed on the second dielectric 613. In this case, the extension line of the second dielectric 612 on which the first feeder 621 is disposed and the extension line of the second dielectric 613 on which the second feeder 622 is disposed may be perpendicular to each other.

Figure 7:
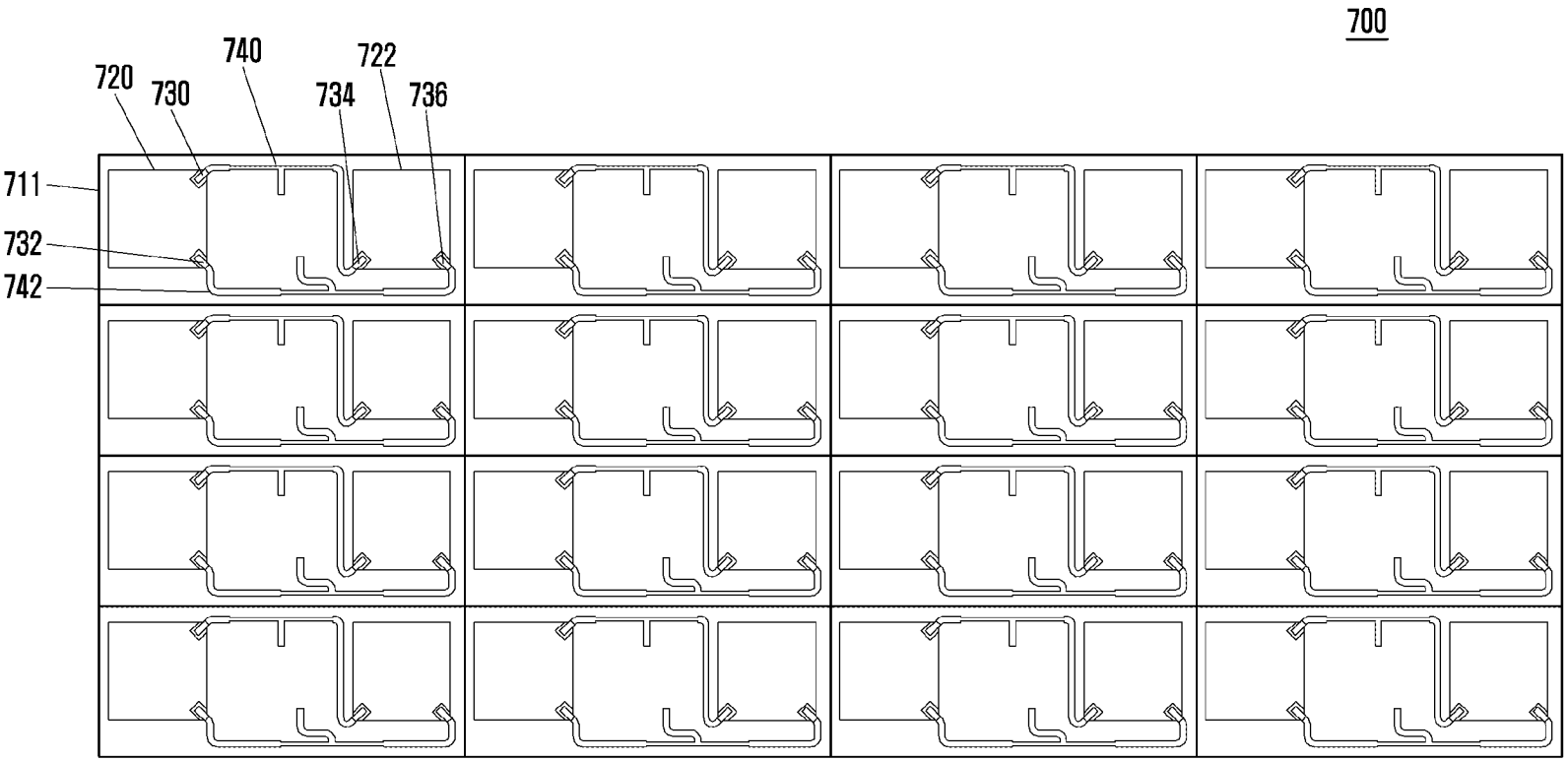
FIG. 7 is a view showing an antenna module including 16 antenna arrays in accordance with an embodiment of the disclosure.

FIG. 7 is a view showing an antenna module including sixteen antenna arrays in accordance with an embodiment of the disclosure.

As described above, according to an embodiment, one antenna module 700 may include a plurality of antenna arrays and FIG. 7 is a view showing the case in which 16 antenna arrays (4×4 antenna array arrangement) is disposed in one antenna module 700.

According to an embodiment, each antenna array may include a first radiator 720 spaced a first distance apart from a first dielectric 711 and a second radiator 722 spaced a second distance apart from the first radiator 720 and spaced the first distance apart from the first dielectric 711.

According to an embodiment, the first radiator 720 can be supplied with an RF signal through the first feeder 730 and the second feeder 732 and the second feeder 722 can be supplied with an RF signal through a third feeder 734 and a fourth feeder 736.

According to an embodiment, the first feeder 730 and the third feeder 734 can be supplied with an RF signal that is supplied from a wireless communication chip (not shown) through a first distributor 740 disposed on the top of the first dielectric 711, and the second feeder 732 and the fourth feeder 736 can be supplied with an RF signal that is supplied from the wireless communication chip through a second distributor 742. In this case, the RF signal that is supplied to a radiator through the first feeder and the third feeder may be an RF signal related to a horizontal polarized wave and the RF signal that is supplied to a radiator through the second feeder and the fourth feeder may be an RF signal related to a vertical polarized wave (or vice versa). That is, the RF signal that is supplied to a radiator through the first feeder and the third feeder may be an RF signal related to a vertical polarized wave and the RF signal that is supplied to a radiator through the second feeder and the fourth feeder may be an RF signal related to a horizontal polarized wave.

According to an embodiment, a separation wall 750 for maintaining isolation between the antenna arrays may be disposed between the antenna arrays. The separation wall 750 may include a metal substance and can improve the isolation of the same polarized wave (horizontal polarized wave or vertical polarized wave) between the antenna array structures.

According to an embodiment, the antenna module 700 according to the disclosure may be disposed in a base station that is used in a next generation mobile communication system and the base station can operate various communication methods such as Multiple User Multiple-Input Multiple-Output (MU-MIMO) and massive-MIMO through the antenna module 700.

The embodiments of the disclosure described and shown in the specification and the drawings have been presented to easily explain the technical contents of the disclosure and help understanding of the disclosure, and are not intended to limit the scope of the disclosure. That is, it will be apparent to those skilled in the art that other modifications and changes may be made thereto on the basis of the technical spirit of the disclosure. Further, the above respective embodiments may be employed in combination, as necessary. For example, the embodiments of the disclosure may be partially combined to operate a base station and a terminal.

What is claimed is:

1. An antenna module comprising at least one antenna array, wherein the antenna module comprises:

a first dielectric having a plate shape for each radiator of the at least one antenna array;

a second dielectric, wherein a first side of the second dielectric is separated from a first side of the first dielectric by a first distance;

a first radiator disposed on the first side of the second dielectric; and a feeder configured to supply a radio frequency (RF) signal to the first radiator, wherein the second dielectric is disposed to support the first radiator, wherein the feeder is associated with a first feeding line for a first polarization and a second feeding line for a second polarization, and wherein the first feeding line and the second feeding line are formed on a side separate from the first radiator by a second distance and separated from the first dielectric by a third distance.

2. The antenna module of claim 1, wherein a direction of the first feeding line is perpendicular to a direction of the second feeding line.

3. The antenna module of claim 1, wherein the first distance is determined based on a wavelength of an electronic wave that is radiated from the first radiator.

4. The antenna module of claim 1, wherein the second distance is determined based on a wavelength of an electronic wave that is radiated from the first radiator.

5. The antenna module of claim 1, further comprising:

a third dielectric, wherein a first side of the third dielectric is separated from the first side of the first dielectric by the first distance;

a second radiator disposed on a second side opposite to the first side of the third dielectric; and a distributor configured to distribute the RF signal, wherein the feeder supplies the RF signal distributed by the distributor to each of the first radiator and the second radiator.

6. The antenna module of claim 1, further comprising:

at least one material disposed on the first side of the first dielectric to dispose the first feeding line and the second feeding line being separated from the second side of first dielectric by the third distance.

7. The antenna module of claim 6, wherein the third distance is shorter than the first distance and a difference between the first distance and the third distance is determined based on a frequency of an electronic wave that is radiated from the first radiator or an overlapping area of the first radiator and the feeder.

8. The antenna module of claim 1, further comprising:

a wireless communication chip or a circuit board disposed on a second side opposite to the first side of the first dielectric and configured to supply the RF signal to the feeder, wherein the antenna module is configured to operate a multiple input multiple output, MIMO, antenna scheme.

9. A base station comprising at least one processor and a plurality of antenna arrays, wherein an antenna module of the base station comprises:

a printed circuit board (PCB);

a first dielectric having a plate shape for each radiator of for an antenna array;

a second dielectric, wherein a first side of the second dielectric is separated from a first side of the first dielectric by a first distance;

a first radiator disposed on the first side of the second dielectric; and a feeder configured to supply a radio frequency (RF) signal to the first radiator, wherein the second dielectric is disposed to support the first radiator, wherein the feeder is associated with a first feeding line for a first polarization and a second feeding line for a second polarization, and wherein the first feeding line and the second feeding line are formed on a side separate from the first radiator by a second distance and separated from the first dielectric by a third distance.

10. The base station of claim 9, wherein a direction of the first feeding line is perpendicular to a direction of the second feeding line.

11. The base station of claim 9, further comprising:

a third dielectric, wherein a first side of the third dielectric is separated from the first side of the first dielectric by the first distance;

a second radiator disposed on a second side opposite to the first side of the third dielectric; and a distributor configured to distribute the RF signal, wherein the feeder supplies the RF signal distributed by the distributor to each of the first radiator and the second radiator.

12. The base station of claim 9, further comprising:

at least one material disposed on the first side of the first dielectric to dispose the first feeding line and the second feeding line being separated from the second side of first dielectric by the third distance.

13. The base station of claim 9, further comprising:

a wireless communication chip or a circuit board disposed on a second side opposite to the first side of the first dielectric and configured to supply the RF signal to the feeder, wherein the antenna module is configured to operate a multiple input multiple output, MIMO, antenna scheme.

14. The antenna module of claim 1, further comprising:

a separation wall disposed on between antenna arrays.

15. The antenna module of claim 5, wherein the feeder is associated with a third feeding line for the first polarization and a fourth feeding line for the second polarization, and wherein the third feeding line and the fourth feeding line are formed on a side separated from the second radiator by the second distance and separated from the first side of the first dielectric by the third distance.

16. The antenna module of claim 1, further comprising:

a metal plate comprising a ground layer, disposed on a second side opposite to the first side of the first dielectric, wherein the first radiator and each of the first feeding line and the second feeding line are electrically connected via a coupling.

17. The antenna module of claim 1, wherein the first radiator is formed on the first side of the second dielectric to face the first side of the first dielectric.

18. The antenna module of claim 1, wherein the second dielectric is disposed to form a space between the first radiator and each of the first feeding line and the second feeding line.

* * * * *